US009488454B2

(12) United States Patent
Kravel

(10) Patent No.: US 9,488,454 B2
(45) Date of Patent: Nov. 8, 2016

(54) WHISTLING SPINNING GRENADE

(71) Applicant: CSI-Penn Arms, LLC, Jamestown, PA (US)

(72) Inventor: Jacob Kravel, Great Neck, NY (US)

(73) Assignee: CSI-PENN ARMS, LLC, Jamestown, PA (US)

( * ) Notice: Subject to any disclaimer, the term of this patent is extended or adjusted under 35 U.S.C. 154(b) by 58 days.

(21) Appl. No.: 14/559,876

(22) Filed: Dec. 3, 2014

(65) Prior Publication Data

US 2016/0161231 A1 Jun. 9, 2016

(51) Int. Cl.
*F42B 12/50* (2006.01)
*F42B 27/08* (2006.01)

(52) U.S. Cl.
CPC ..... *F42B 12/50* (2013.01); *F42B 27/08* (2013.01)

(58) Field of Classification Search
CPC ..... F42B 12/46–12/52; B65D 83/28–83/306
See application file for complete search history.

(56) References Cited

U.S. PATENT DOCUMENTS 3,117,521 A * 1/1964 Reaves ..... F42B 12/50 102/368
3,361,065 A * 1/1968 Litman ..... F42B 12/50 102/368
3,635,372 A * 1/1972 Van Dyck ..... F41H 9/10 222/135
3,785,569 A * 1/1974 Helmrich ..... B65D 83/28 102/368
4,568,002 A * 2/1986 Weinstein ..... B65D 83/205 222/131
4,976,202 A * 12/1990 Honigsbaum ..... F42B 12/50 102/302
5,402,943 A * 4/1995 King ..... B05B 1/00 239/11
6,543,364 B2 4/2003 Wes et al.
7,191,708 B2 * 3/2007 Ouliarin ..... F42B 8/18 102/355
8,726,810 B2 5/2014 Kravel
8,899,156 B1 * 12/2014 Tseng ..... F42B 12/36 102/368

OTHER PUBLICATIONS

ISPRA Ltd. "Tear Gas Grenades," http://www.ispraltd.com/Product.asp?PiD=0.4.17^cid=26, (c) 2009, Accessed Sep. 16, 2014.

* cited by examiner

*Primary Examiner* — Stephen M Johnson
*Assistant Examiner* — Joshua Semick
(74) *Attorney, Agent, or Firm* — Bennet K. Langlotz; Langlotz Patent & Trademark Works, Inc.

(57) ABSTRACT

A whistling spinning grenade has a body defining a body axis and having a sidewall and a hollow interior, the body interior containing a teargas generation component and an ignition component, the body sidewall defining a plurality of passages, each passage communicating from the interior of the body to an exhaust aperture, each exhaust aperture penetrating the body sidewall and defining an exhaust aperture axis, and each exhaust aperture axis being angularly offset from a radius connecting the passage to the body axis, such that it has a tangential directional component with respect to the sidewall, and wherein rotation of the grenade about the body axis is propelled by the expulsion of exhaust gas through the exhaust apertures. The teargas generation component may be proximate the ignition component such that combustion of the ignition component ignites the teargas generation component. The passages and exhaust apertures may be all coplanar.

24 Claims, 4 Drawing Sheets

WHISTLING SPINNING GRENADE

FIELD OF THE INVENTION

The present invention relates to grenades, and more particularly to gas grenades for crowd control.

BACKGROUND OF THE INVENTION

Hand thrown and launched teargas grenades are commonly used by police forces for riot control and to disable barricaded suspects. However, sometimes persons encountering teargas grenades are able to grab the grenade and throw it back at the security forces while it is still emitting teargas. One approach to minimizing the possibility of a person picking up and throwing a teargas grenade back is to emit the teargas from the grenade at a high flow rate, which leaves little time for a person to pick up and throw the grenade. Another is to cause the grenade to become sufficiently hot to prevent the grenade from being picked up with bare hands. However, these measures may not be sufficient when police officers face prepared individuals wearing heat-resistant gloves because the grenades are motionless and quiet after they land. In addition, existing grenades, whether or not they are easily grasped to throw back, appear harmless and familiar (based on news and movie images) and do not deter attempts to throw them back at police forces.

Therefore, a need exists for a new and improved grenade that emits a gas through lateral passages and apertures to cause spinning and loud, unpleasant whistling, thereby preventing a person from picking up the grenade and throwing it while the grenade is emitting gas. In this regard, the various embodiments of the present invention substantially fulfill at least some of these needs. In this respect, the whistling spinning grenade according to the present invention substantially departs from the conventional concepts and designs of the prior art, and in doing so provides an apparatus primarily developed for the purpose of providing a grenade that prevents a person from picking up the grenade and throwing it while the grenade is emitting teargas.

SUMMARY OF THE INVENTION

The present invention provides an improved whistling spinning grenade, and overcomes the above-mentioned disadvantages and drawbacks of the prior art. As such, the general purpose of the present invention, which will be described subsequently in greater detail, is to provide an improved whistling spinning grenade that has all the advantages of the prior art mentioned above.

To attain this, the preferred embodiment of the present invention essentially comprises a body defining a body axis and having a sidewall and a hollow interior, the body interior containing a teargas generation component and an ignition component, the body sidewall defining a plurality of passages, each passage communicating from the interior of the body to an exhaust aperture, each exhaust aperture penetrating the body sidewall and defining an exhaust aperture axis, and each exhaust aperture axis being angularly offset from a radius connecting the passage to the body axis, such that it has a tangential directional component with respect to the sidewall, and wherein rotation of the grenade about the body axis is propelled by the expulsion of exhaust gas through the exhaust apertures. The teargas generation component may be proximate the ignition component such that combustion of the ignition component ignites the teargas generation component. The passages and exhaust apertures may be all coplanar.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
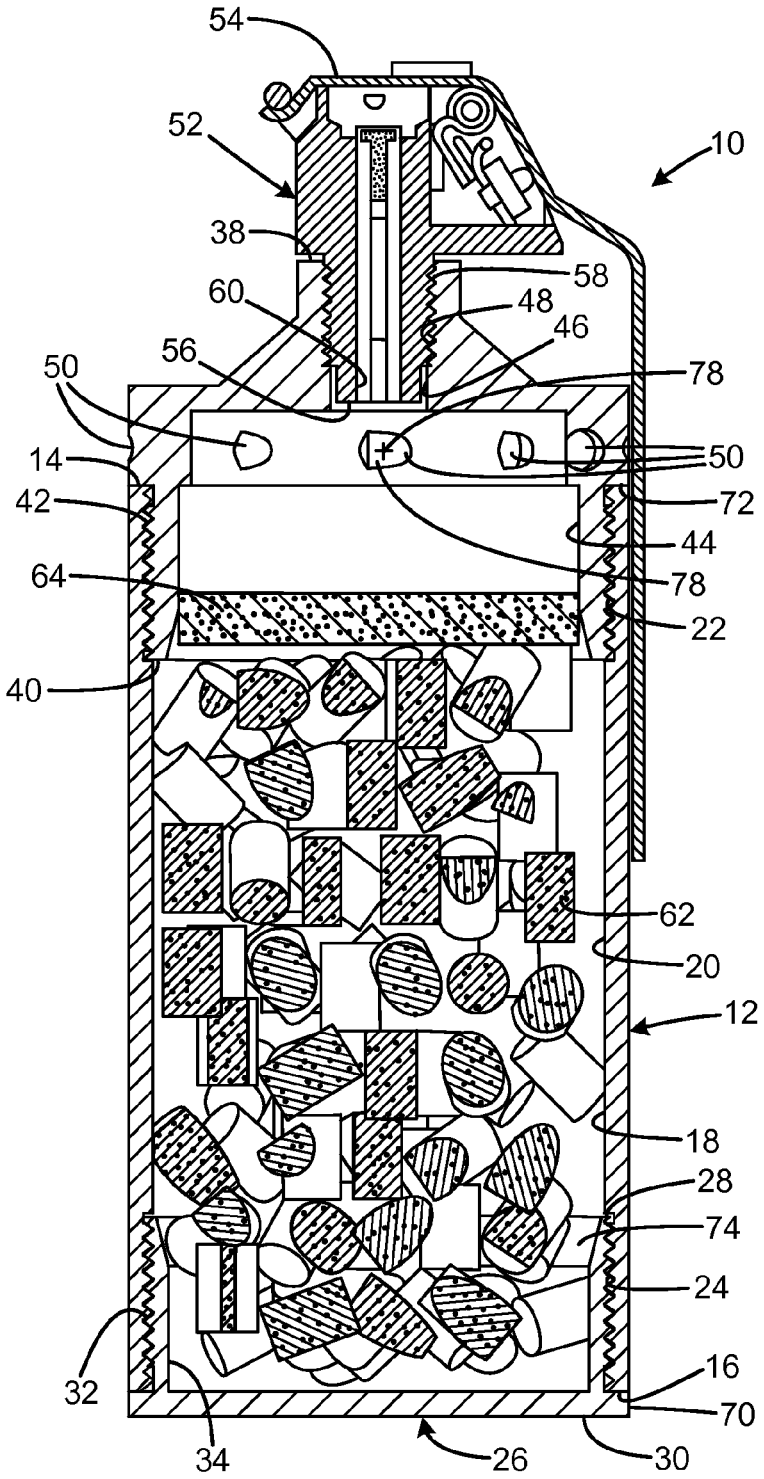
FIG. 1 is a side sectional view of the current embodiment of a whistling spinning grenade constructed in accordance with the principles of the present invention.

An embodiment of the whistling spinning grenade of the present invention is shown and generally designated by the reference numeral 10.

FIG. 1 illustrates the improved whistling spinning grenade 10 of the present invention in a filled state. More particularly, the whistling spinning grenade has a cylindrical body 12 having a top 14, a bottom 16, and a central bore 18 that defines an interior 20. The top of the interior defines a top threaded portion 22. The bottom of the interior defines a bottom threaded portion 24.

A bottom cap 26 has a top 28, a bottom 30, an interior 34, and an outwardly protruding flange 70. The exterior of the top cap has a threaded portion 32 that extends from the top to the bottom. The bottom cap is threadedly attached to the bottom 16 of the body 12 by engagement of the threaded portion 32 with the bottom threaded portion 24 of the body. In the current embodiment, the flange protrudes outward by an amount equal to the thickness of the body to provide a flush fit between the bottom cap and the body.

A top cap 36 has a top 38, a bottom 40, an interior 44, and a shoulder 72. The exterior of the top cap has a threaded portion 42 that extends from the bottom to proximate the shoulder. The top cap is threadedly attached to the top 14 of the body 12 by engagement of the threaded portion 42 with the top threaded portion 22 of the body. In the current embodiment, the shoulder protrudes outward by an amount equal to the thickness of the body to provide a flush fit between the top cap and the body.

The top 38 of the top cap 36 defines a central bore 46 in communication with the interior 44. The central bore has a threaded portion 48. The top cap defines a plurality of perimeter passages and apertures 50 that communicate between the interior of the top cap and the external environment. The perimeter passages and apertures will be described in more detail during the discussion of FIGS. 2A-C.

A fuse 52 has a top 54, a bottom 56, and a central bore 60. The bottom exterior of the fuse has a threaded portion 58. The fuse is threadedly attached to the top 38 of the top cap 36 by engagement of the threaded portion 58 with the threaded portion 48 in the central bore 46 of the top. In the current embodiment, the fuse 52 is the fuse disclosed in U.S. Pat. No. 8,726,810, which is hereby incorporated by reference in its entirety.

When the whistling spinning grenade 10 is in a filled state, the interior 34 of the bottom cap 26 and the interior 20 of the body 12 receive a plurality of CS (2-chlorobenzalmalononitrile) pellets 62. The bottom 40 of the interior 44 of the top cap 36 receives a layer of slurry 64. When the fuse 52 is triggered, a spark travels down the central bore 60 into the interior 44 of the top. The spark ignites the slurry 64. The burning slurry ignites the CS pellets, which causes the CS pellets to burn at a very high rate, generating gas and pressure. The gases generated by the burning slurry and CS pellets are emitted into the external environment via the perimeter apertures 50. In the current embodiment, the whistling spinning grenade 10 is adapted to be hand thrown. However, the whistling spinning grenade 10 can be altered to be launched by any desired firearm.

Figure 2A:
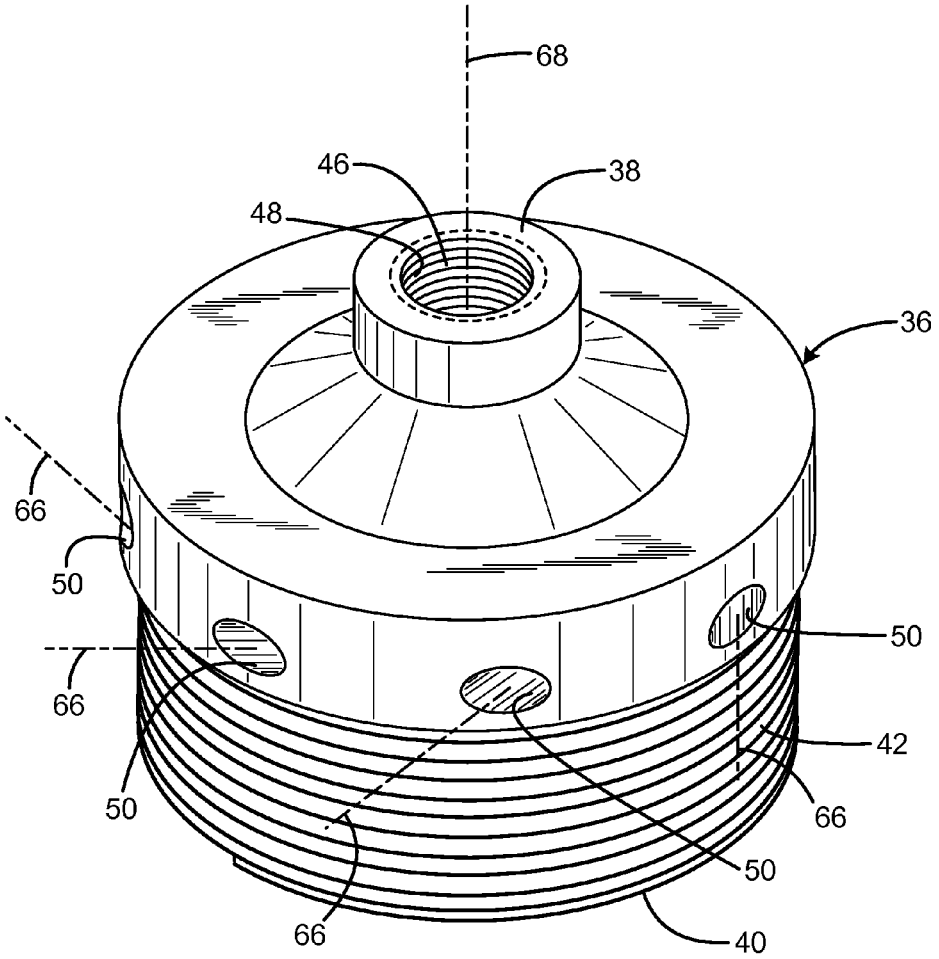
FIG. 2A is a top isometric view of the current embodiment of the top cap for the whistling spinning grenade of FIG. 1.
Figure 2B:
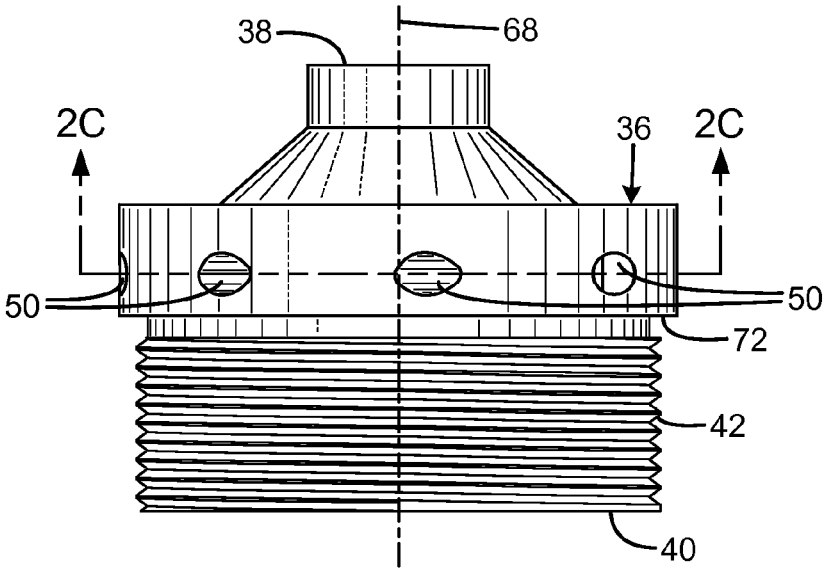
FIG. 2B is a side view of the current embodiment of the top cap for the whistling spinning grenade of FIG. 1.
Figure 2C:
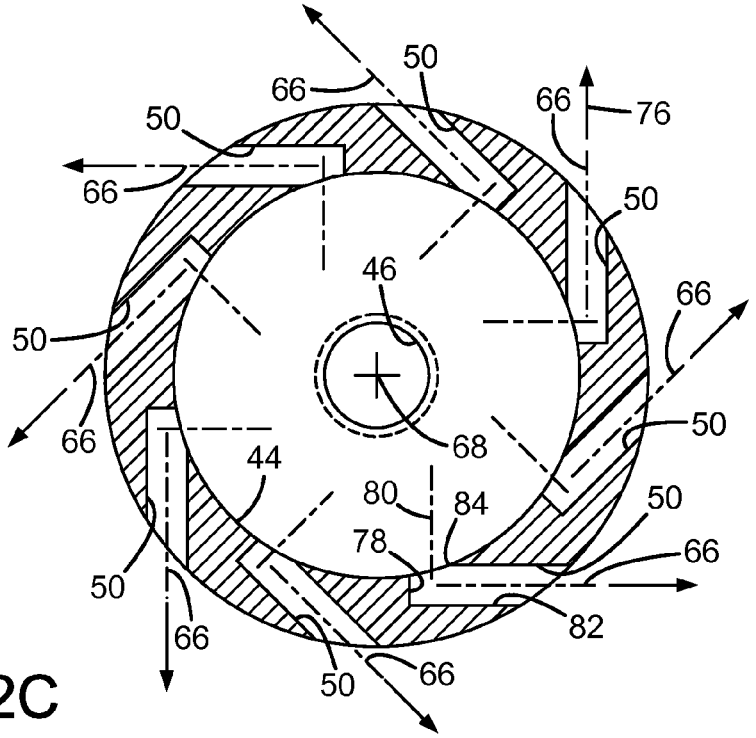
FIG. 2C is a top sectional view of the current embodiment of the top cap for the whistling spinning grenade of FIG. 1.

FIGS. 2A-C illustrates the improved top cap 36 of the present invention. More particularly, the top cap has eight perimeter passages and apertures 50 in the current embodiment. Each of the perimeter passages and apertures defines an intake passage segment 78, an exhaust passage segment 82, an exhaust aperture axis 66, and an intake aperture axis 80. The exhaust passages and apertures each have a thrust direction 76 in which exhaust gas pressure in the interior chamber formed by the interior 34 of the bottom cap 26 and the interior 20 of the body 12 is relieved by venting through the exhaust apertures.

The perimeter passages and apertures 50 are arranged with rotational symmetry about the central bore axis 68 of the body 12 and are equally spaced around the top cap every 45° in the current embodiment. The passage axes 66 are positioned offset from a radius connecting the passages to the central bore axis, such that the passage axes and the thrust directions have a tangential directional component with respect to the sidewall tangentially to the interior 44 and perpendicularly to the central bore axis, and are coplanar in the current embodiment. The tangential thrust direction components are in a common rotational direction such that the apertures generate thrust in a common rotational direction.

Because the passage axes are coplanar and equally spaced around the top cap, the whistling spinning grenade 10 expels gas through the perimeter passages and apertures that impels the grenade to spin rapidly about the central bore axis of the body at a rate of at least 20,000 RPM, but to travel minimally within a space of 100 sq. ft. or less. The grenade can spin either upside down or right side up, but always spins in a vertical position because the lateral jetting through the perimeter passages and apertures pushes the top cap up away from the ground. The grenade does not move axially in response to gas exhausting through the perimeter passages and apertures because the thrust directions are parallel to a common plane perpendicular to the central bore axis and are arranged symmetrically to generate a neutral axial thrust.

The perimeter passages and apertures 50 are half blind where they communicate with the interior 44 and have the geometry of a whistle. The apertures each have an intake passage segment 78 with an intake aperture axis 80 and an exhaust passage segment 82 with a passage axis 60. The intake aperture axes are perpendicular to the passage axes, and the intake passage segments meet the exhaust passage segments such that a sharp lip 84 is defined. The sharp lips generate a flow discontinuity as gas is exhausted through the apertures. The sharp lip is positioned only at one side of the apertures, such that the sharp lip is not concentric with the aperture. The half blind U-shaped openings where the perimeter passages communicate with the interior (shown in FIG. 1) create oscillating sound waves that then tumble around within the passages. As the compressed gas escapes from the apertures on the other end of the passages, the gas creates an audible tonal sound with a pitch based on the rotational velocity of the grenade. The perimeter passages and apertures are 4.76 mm to 5.0 mm in diameter, with 4.76 mm being preferred. If the perimeter passages and apertures are smaller in diameter, the whistling spinning grenade 10 is likely to explode. The smaller holes create pressure in the grenade faster and cause the grenade to spin faster and generate a louder noise. The passages are 1.1 inch long, which produces higher pitches relative to a longer passage length.

The gas emitted through the perimeter passages and apertures generates a profound pulsing, whistling sound of at least 120 dB because the whistling spinning grenade 10 is spinning. Sound also originates from the asymmetrical shape of the fuse body passing through air at over 20,000 RPM. The sound is very unpleasant, which deters an individual from approaching the grenade while the grenade is emitting gases. The spinning action also makes it very difficult for an individual to grab and throw the grenade while the grenade is emitting gases. As a result, the grenade is very unlikely to be thrown back at security forces while it is still emitting gases.

In the current embodiment, the perimeter apertures 50 are located 1.062 inches from the bottom 40 of the top cap 36. The passage axes 66 are located 0.966 inches from the central bore axis 68 and 0.284 inches from the exterior of the top cap. The threaded portion 42 has left-handed threads with a pitch of 12 threads per inch. The widest portion of the top cap has an outer diameter of 2.5 inches.

Figure 3:
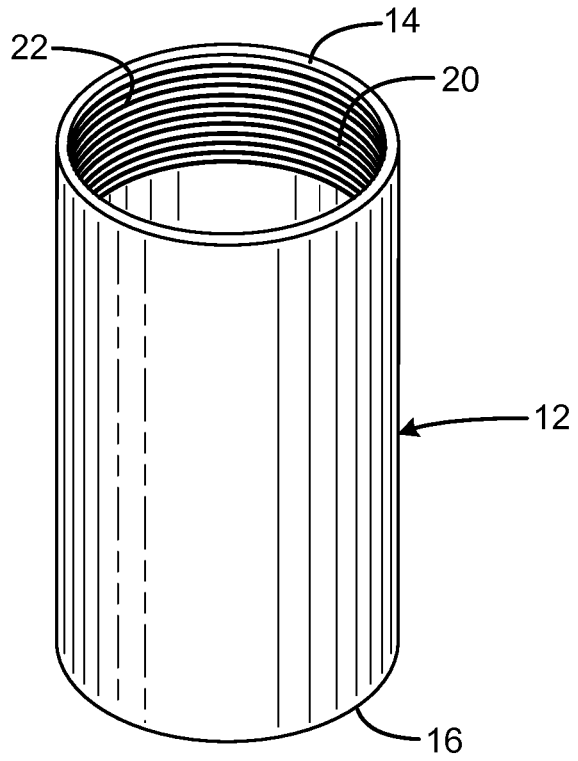
FIG. 3 is a top isometric view of the current embodiment of the body for the whistling spinning grenade of FIG. 1.

FIG. 3 illustrates the improved body 12 of the present invention. More particularly, the body has a length of 4.5 inches, an outer diameter of 2.5 inches, and an inner diameter of 2.255 inches in the current embodiment. In the current embodiment, the top threaded portion 22 and bottom threaded portion 24 each have a length of 0.875 inches and are left-handed threads with an undercut and a pitch of 12 threads per inch.

Figure 4:
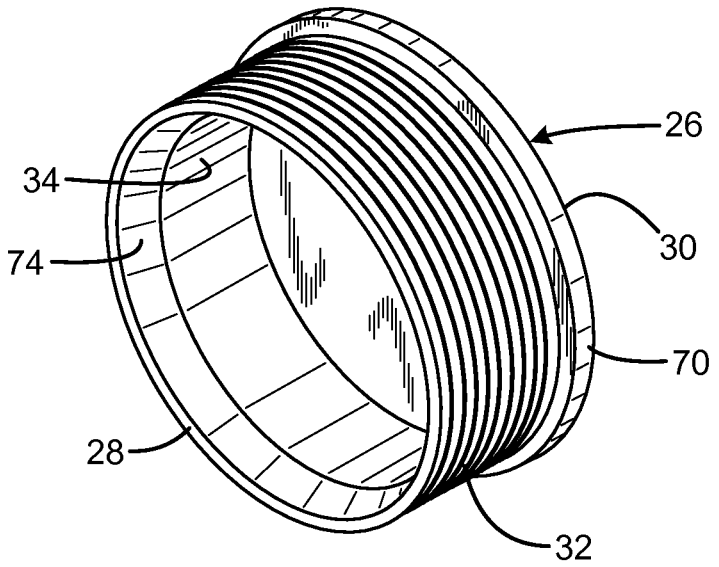
FIG. 4 is a top isometric view of the current embodiment of the bottom cap for the whistling spinning grenade of FIG. 1.

FIG. 4 illustrates the improved bottom cap 26 of the present invention. More particularly, the top cap has a height of 1.000 inches, an outer diameter of 2.35 inches, an inner diameter of 2.100 inches, and a sloped portion 74 of 0.250"× 14° in the current embodiment. The flange 70 has a thickness of 0.125 inches, and the threaded portion 32 is left-handed threads with an undercut and a pitch of 12 threads per inch in the current embodiment.

While a current embodiment of a whistling spinning grenade has been described in detail, it should be apparent that modifications and variations thereto are possible, all of which fall within the true spirit and scope of the invention. For example, the eight perimeter passages and apertures described can be replaced by four or six passages and apertures. Furthermore, a colored smoke generation component can be used instead of, or in addition to, the CS pellets to build pressure within the whistling spinning grenade.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A grenade comprising:

a body defining a body axis and having a sidewall and a hollow interior;

the body interior containing a teargas generation component and an ignition component;

the body sidewall defining a plurality of passages, each passage communicating from the interior of the body to an exhaust aperture;

each exhaust aperture penetrating the body sidewall and defining an exhaust aperture axis;

each exhaust aperture having an articulated discontinuous surface shape operable to generate a sound having a pitch upon rotation of the body in response to passage of gas from the interior; and each exhaust aperture axis being angularly offset from a radius connecting the passage to the body axis, such that it has a tangential directional component with respect to the sidewall, and wherein rotation of the grenade about the body axis is propelled by the expulsion of exhaust gas through the exhaust apertures.

2. The grenade of claim 1 wherein the teargas generation component is proximate the ignition component such that combustion of the ignition component ignites the teargas generation component.

3. The grenade of claim 1 wherein the passages and exhaust apertures are all coplanar.

4. The grenade of claim 1 wherein the passages and exhaust apertures are equally spaced around the body sidewall.

5. The grenade of claim 1 wherein the passages and exhaust apertures are spaced at 45° from each other.

6. The grenade of claim 1 wherein there are 8 passages and 8 exhaust apertures.

7. The grenade of claim 1 wherein the passage axes are perpendicular to the body axis.

8. The grenade of claim 1 wherein the passages are half blind with a whistle geometry where the passages communicate with the interior.

9. The grenade of claim 1 wherein the passages and exhaust apertures expel gases resulting from combustion of the ignition component and vaporization of the teargas generation component.

10. The grenade of claim 8 wherein the expelled gases generate a whistling sound of at least 120 dB.

11. The grenade of claim 9 wherein the expelled gases cause the body to spin about the body axis at a rate of at least 20,000 RPM.

12. The grenade of claim 1 wherein the body includes a threadedly attached top cap that defines the exhaust apertures.

13. The grenade of claim 1 wherein the body includes a cylindrical canister portion.

14. The grenade of claim 1 wherein the body includes a threadedly attached bottom cap.

15. The grenade of claim 8 wherein the passages have a diameter of at least 4.76 mm.

16. The grenade of claim 8 wherein the passages have a length less than or equal to 1.1 inch.

17. A grenade comprising:

a body defining a body axis and defining a chamber;

the chamber containing a teargas generation component and an ignition component; the body defining a plurality of exhaust apertures, each exhaust aperture communicating externally from the chamber;

the chamber being open to the atmosphere within gas communication via the exhaust apertures wherein relative pressure differentials are relieved by gas flow through the exhaust apertures;

each exhaust aperture having a thrust direction in which exhaust gas pressure in the chamber is relieved by venting through the exhaust aperture;

each thrust direction having a tangential direction component with respect to the body axis, such that the body is impelled to spin about the axis in response to expulsion of gases from the chamber via the exhaust apertures;

each exhaust aperture having a whistle geometry wherein a tonal sound having a pitch is generated upon expulsion of gas via the exhaust apertures while the body is rotating; and wherein each exhaust aperture defines a passage including a sharp lip at an intermediate location along the passage to generate a flow discontinuity as gas is exhausted through the aperture.

18. The grenade of claim 17 wherein the thrust directions are parallel to a common plane perpendicular to the body axis, such that the grenade does not move axially in response to gas exhausting from the chamber.

19. The grenade of claim 17 wherein the thrust directions are arranged symmetrically to generate a neutral axial thrust, such that the grenade does not move axially in response to exhaust gas thrust.

20. The grenade of claim 17 wherein the apertures are arranged with rotational symmetry about the body axis.

21. The grenade of claim 17 wherein the apertures each have an articulated interior shape such that expulsion of exhaust gases generates a tonal sound having a pitch.

22. The grenade of claim 17 wherein the apertures each have a first interior passage segment defining a first axis, and a second exterior passage defining a second axis offset from the first axis, such that exhaust gas flow generates a tonal sound that has a pitch based on the rotational velocity of the grenade.

23. The grenade of claim 17 wherein the tangential thrust direction components are in a common rotational direction such that the apertures generate thrust in a common rotational direction.

24. The grenade of claim 17 wherein the sharp lip is positioned only at one side of the aperture, such that the sharp lip is not concentric with the aperture.

* * * * *